US011318058B2

(12) United States Patent
Berg

(10) Patent No.: US 11,318,058 B2
(45) Date of Patent: May 3, 2022

(54) LIFT FOR WATER ENTRY/EXIT AND METHODS OF MANUFACTURE AND USE THEREOF

(71) Applicant: Malcolm Berg, Coral Gables, FL (US)

(72) Inventor: Malcolm Berg, Coral Gables, FL (US)

( * ) Notice: Subject to any disclaimer, the term of this patent is extended or adjusted under 35 U.S.C. 154(b) by 49 days.

(21) Appl. No.: 16/379,946

(22) Filed: Apr. 10, 2019

(65) Prior Publication Data

US 2020/0323719 A1 Oct. 15, 2020

(51) Int. Cl.
*A61G 7/10* (2006.01)

(52) U.S. Cl.
CPC ..... *A61G 7/1005* (2013.01); *A61G 7/1019* (2013.01); *A61G 7/1059* (2013.01); *A61G 7/1076* (2013.01)

(58) Field of Classification Search
CPC ..... A47C 1/121; A47C 1/126; A47C 4/00; A47C 4/04; A47C 4/08; A47C 4/18; A47C 7/56; A47C 7/563; A61G 7/1001; A61G 7/1003–1005; A61G 7/1007; A61G 7/1019; A61G 7/1074; E04H 4/144
USPC ..... 297/331, 335; 4/496, 504, 562.1, 564.1
See application file for complete search history.

(56) References Cited

U.S. PATENT DOCUMENTS 3,088,123 A * 5/1963 Loughridge ..... E06C 9/00 4/496
3,994,030 A * 11/1976 Cassell ..... A61G 7/1003 4/563.1
4,141,089 A * 2/1979 Krumbeck ..... A61G 7/1044 187/275
4,183,106 A 1/1980 Brown et al.
4,221,008 A 9/1980 Nolan
4,569,091 A * 2/1986 Brandenberger .... A61G 7/1003 4/562.1
4,588,155 A 5/1986 James
D297,876 S 9/1988 Nolan
(Continued)

FOREIGN PATENT DOCUMENTS

FR 2833162 A3 6/2003
GB 1029525 * 8/2000 ..... A61G 7/10

OTHER PUBLICATIONS

A summary of accessibility guidelines for recreation facilities, United States Access Board, Jun. 2003. pp. 1-23.

*Primary Examiner* — David P Angwin
*Assistant Examiner* — Nicholas A Ros
(74) *Attorney, Agent, or Firm* — Gregory L. Mayback; Dickinson Wright PLLC

(57) ABSTRACT

A lift transporting a person into and out from a water-containing structure having an interior wall includes a waterproof base assembly attached to the wall and having at least a portion thereof submerged in the structure, a waterproof seat assembly and a drive assembly. The seat assembly includes a lifting beam movably disposed with respect to a base housing and defining a seat arm chamber and a chair assembly comprising a chair arm movably connected to the lifting beam within the seat arm chamber to travel between a stowed position and a deployed position and a chair movably connected to the chair arm to travel between a stowed position and a deployed position. The drive assembly is operatively connected at least to the lifting beam and raises and lowers the lifting beam with respect to the lifting arm chamber and rotates the lifting beam with respect to the lifting arm chamber.

21 Claims, 7 Drawing Sheets

(56) References Cited

U.S. PATENT DOCUMENTS

| | | | | |
|---|---|---|---|---|
| 5,146,638 | A * | 9/1992 | Richards | A61G 7/1003 4/562.1 |
| 5,465,433 | A | 11/1995 | Nolan | |
| 5,715,545 | A * | 2/1998 | Forwick | A61G 7/1003 4/563.1 |
| 6,351,860 | B1 * | 3/2002 | Schaffer | A61G 7/1003 4/560.1 |
| 6,378,659 | B1 * | 4/2002 | Krumbeck | A61G 7/1005 187/200 |
| 6,941,592 | B1 * | 9/2005 | Castillo | A61G 7/1003 4/560.1 |
| 2004/0098801 | A1 * | 5/2004 | Sherlock | A61G 7/1003 4/579 |
| 2007/0006374 | A1 | 1/2007 | Sors | |
| 2008/0010740 | A1 * | 1/2008 | Tenan | A61G 7/1003 4/562.1 |
| 2010/0122406 | A1 | 5/2010 | Gschwind | |
| 2011/0278884 | A1 * | 11/2011 | Marchesi | B61D 41/00 297/135 |
| 2013/0312174 | A1 * | 11/2013 | Kanetis | A61G 7/1074 4/496 |
| 2015/0013059 | A1 * | 1/2015 | Kelly | A61G 7/1005 4/496 |
| 2018/0319293 | A1 * | 11/2018 | Joshi | B60N 2/3011 |

* cited by examiner

LIFT FOR WATER ENTRY/EXIT AND METHODS OF MANUFACTURE AND USE THEREOF

STATEMENT REGARDING FEDERALLY SPONSORED RESEARCH OR DEVELOPMENT

Not Applicable

FIELD OF THE INVENTION

The present systems, apparatuses, and methods lie in the field of lifts for persons. The present disclosure relates to a lift for water entry/exit and methods of manufacture and use thereof.

BACKGROUND OF THE INVENTION

Accessible chair lifts are commonplace and typically are required in most commercial pools, spas, hydrotherapy vessels, and other water-containing structures in which a person is to be immersed. These lifts are configured to provide submerged access to people with disabilities or limited mobility. The lifts tend to be bulky, obtrusive, unattractive, and cumbersome. By most enforceable municipal codes, the lifts must be permanent structures that become readily available should they be required by a user. This requirement presents two major problems to a property owner/operator. First, such lifts are typically visually imposing and detract from the intended aesthetic. Second, the lifts establish a physical barrier around a portion of the water structure. Access to the water around the perimeter of the structure is generally required by most municipal codes for life safety reasons, and the presence of a permanent apparatus mounted in this perimeter limits access in the immediate area.

Thus, a need exists to overcome the problems with the prior art systems, designs, and processes as discussed above.

SUMMARY OF THE INVENTION

The systems, apparatuses, and methods described provide a lift for water entry/exit and methods of manufacture and use thereof that overcome the hereinafore-mentioned disadvantages of the heretofore-known devices and methods of this general type and that provide such features with a mostly submerged apparatus, mounted to inside face of pool or other water vessel, which provides access for people with disabilities or limited mobility to pools, spas, and other natural or manmade vessels containing water or similar liquid. Mostly submerged, in this context, means that, when not in use, the lift is submerged and exits the water only during use. In an exemplary embodiment, the lift comprises a telescoping arm and a supporting a seat assembly that are configured to be stored in a compact form within the water and, therefore, preserving the aesthetic of the water-containing structure in which a person is to enter and exit. The arm emerges vertically from the water. Once emerged, it rotates a seat assembly on a vertical axis until the seat assembly is over an adjacent portion of a deck, thereby becoming easily accessible to the user. The arm then unfolds a seat, seat back, and/or footrests to receive an occupant or rider. The arm then rotates the seat assembly about the vertical axis until the seat is over the water to, then, submerge the seat and rider and allow discharge of the rider into the water.

Provided is a lifting apparatus for water entry/exit that, while not in operation, remains mostly or completely submerged in liquid (e.g., water) and, therefore, mostly or completely concealed from a view outside the structure (of course, at least a portion of the lift is visible through the water itself if an underwater enclosure is not completely obscuring the viewer's sight of the lift). While prior art lifts provide access to pools, and some are partially mounted to the inside of pools, the lifting apparatus, systems, and methods described and shown are the first to be mostly or completely submerged, wholly mounted to an inside face or wall of the water-containing structure. The lift is a self-contained apparatus that folds to a nominal profile against the interior wall of the structure.

The lift comprises a mounting bracket, a telescoping arm, a seat assembly, and a replaceable, hermetically sealed motor/battery assembly. The lift is activated by the user, or others, by remote control or by other directly connected measures. Upon activation, by rider or other operator, it will extend a telescoping arm vertically, exposing a previously submerged, folded seat assembly. The telescoping arm will allow the seat assembly to rotate approximately 180 degrees to be accessible from the approach side. It will allow the seat, the seat back and footrest, to be unfolded. Once the rider has mounted the apparatus the seat assembly will be rotated approximately 180 degrees until the rider is directly over water, then the apparatus will be activated to lower and submerge the seat assembly. Once safely submerged, the rider can dismount the apparatus. The apparatus could either be left submerged while the rider is in the water or retrieved into the above-deck configuration to provide unobstructed swimming or wading. The apparatus would be left in the unfolded configuration until the rider is ready to egress the body of water. In order to egress the body of water, the apparatus would again be submerged and the rider would mount the apparatus. Upon activation, by rider or other operator, it will extend the telescoping arm vertically, lifting the seat assembly and rider out of the water. Once the seat and footrest clear the adjacent structure the seat assembly would be rotated approximately 180 degrees to allow for rider's assisted or unassisted dismount.

The invention clearly overcomes the burden of having a permanently affixed apparatus prominently mounted on the deck, around the perimeter of a pool or other water vessel, by storing the apparatus in a submerged and folded configuration. This is a great asset to the pool as it frees up valuable pool deck area, pertinent from a usability, efficiency, life safety, and aesthetic standpoint. The medical, multifamily residential, hospitality, and wellness industries (among many others) all rely on pools and are bound to accessibility requirements. All of these industries, commonly burdened by unsightly contraptions in their landscape, would welcome an invention that provides an aesthetically pleasing solution to the need for water vessel accessibility.

From a usability and efficiency standpoint it allows all of the pool deck to be used, uninterrupted. From a life safety standpoint, it allows access to the entire perimeter of the pool in case of needing to provide assistance to a swimmer or patient in distress. From an aesthetic standpoint, it allows for uninterrupted views of the pool deck and beyond while the apparatus is not in use. The submerged and folded configuration allows for uninterrupted swimming by providing a shallow projection into the swim area from the water vessel wall.

With the foregoing and other objects in view, there is provided, a lift for transporting a person into and out from a water-containing structure having an interior wall comprises a waterproof base assembly configured to attach to the interior wall and have at least a portion of the base assembly remain submerged in the water-containing structure, the base assembly comprising a base housing to be fixed to the interior wall, the base housing having an exterior surface and defining a lifting arm chamber with an arm slot that communicates and extends from an interior of the lifting arm chamber to the exterior surface, a waterproof seat assembly comprising a lifting beam movably disposed with respect to the base housing and defining a seat arm chamber and a chair assembly comprising a chair arm movably connected to the lifting beam within the seat arm chamber to travel between a stowed position and a deployed position and a chair movably connected to the chair arm to travel between a stowed position and a deployed position, and a drive assembly operatively connected at least to the lifting beam and configured to raise and lower the lifting beam with respect to the lifting arm chamber and to rotate the lifting beam with respect to the lifting arm chamber.

With the objects in view, there is also provided a lift for transporting a person into and out from a water-containing structure having an interior wall comprises a waterproof base assembly configured to attach to the interior wall and have at least a portion of the base assembly remain submerged in the water-containing structure, a waterproof seat assembly comprising a lifting beam movably disposed with respect to the base housing and defining a seat arm chamber and a chair assembly comprising a chair arm movably connected to the lifting beam within the seat arm chamber to travel between a stowed position and a deployed position and a chair movably connected to the chair arm to travel between a stowed position and a deployed position, and a drive assembly operatively connected at least to the lifting beam and configured to raise and lower the lifting beam with respect to the lifting arm chamber and to rotate the lifting beam with respect to the lifting arm chamber.

In accordance with another feature, the structure has a floor and the base housing extends to the floor.

In accordance with a further feature, the base housing has curved exterior surfaces.

In accordance with an added feature, the base housing is hemicylindrical in shape.

In accordance with an additional feature, the arm slot extends as a vertical slot from the interior of the lifting arm chamber to the exterior surface of the base housing.

In accordance with yet another feature, the chair arm is a beam that fits within and moves with respect to the vertical arm slot.

In accordance with yet a further feature, in the stowed position of the chair arm, the chair arm is in a vertical orientation and rests substantially within the seat arm chamber and, in the deployed position of the chair arm, the chair arm is in a substantially horizontal orientation and at least a portion of the chair arm extends out from the seat arm chamber.

In accordance with yet an added feature, the lifting arm chamber defines a vertical axis and the chair has a seating surface and, in the stowed position of the chair arm, the seating surface is in a substantially vertical orientation parallel to the vertical axis and, in the deployed position of the chair arm, the seating surface is in a substantially horizontal orientation in which a person can seat upon the chair.

In accordance with yet an additional feature, the lifting arm chamber is cylindrical in shape and has a vertical axis and the lifting beam comprises a cylinder movable to lower into and raise from the lifting arm chamber and to spin within the lifting arm chamber about the vertical axis.

In accordance with again another feature, the lifting beam has a stored position when lowered into the lifting arm chamber and has a deployed position at least partially raised from the lifting arm chamber.

In accordance with again a further feature, the chair has a seating surface and, in the stowed position of the chair, the seating surface is substantially parallel to the vertical axis and, in the deployed position of the chair, the seating surface is in a substantially horizontal orientation in which a person can seat upon the chair.

In accordance with again an added feature, in the stowed position of the chair, the chair arm is substantially parallel to the vertical axis substantially within the base housing and, in the deployed position of the chair, the chair arm is in a deployed position out of the seat arm chamber in a substantially horizontal orientation.

In accordance with again an additional feature, the drive assembly actively pivots the chair arm with respect to the lifting beam between a stored vertical position and a deployed substantially horizontal position.

In accordance with still another feature, the drive assembly passively pivots the chair arm by gravity with respect to the lifting beam from a stored vertical position to a deployed substantially horizontal position.

In accordance with still a further feature, the drive assembly comprises a power source and a drive powered by the power source.

In accordance with still an added feature, the power source is a battery and the drive is an electric, battery-powered motor.

In accordance with still an additional feature, the drive assembly comprises a hermetically sealed, motor and battery replaceable and exchangeable part.

In accordance with another feature, the chair comprises a seat back having a stowed position and a deployed position, the chair comprises a footrest having a stowed position and a deployed position, and the drive assembly actively moves the seat back and the footrest respectively between the stowed position and the deployed position.

In accordance with a concomitant feature, the drive assembly is configured to raise the lifting beam to place the chair above water present within the water-containing structure and to rotate the lifting beam to move the chair from above the water to over a deck of the water-containing structure.

Although the systems, apparatuses, and methods are illustrated and described herein as embodied in a lift for water entry/exit and methods of manufacture and use thereof, it is, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems, apparatuses, and methods.

Additional advantages and other features characteristic of the systems, apparatuses, and methods will be set forth in the detailed description that follows and may be apparent from the detailed description or may be learned by practice of exemplary embodiments. Still other advantages of the systems, apparatuses, and methods may be realized by any of the instrumentalities, methods, or combinations particularly pointed out in the claims.

Other features that are considered as characteristic for the systems, apparatuses, and methods are set forth in the appended claims. As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one of ordinary skill in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the systems, apparatuses, and methods of the invention that are regarded as novel, it is believed that the systems, apparatuses, and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems, apparatuses, and methods. Advantages of embodiments of the systems, apparatuses, and methods will be apparent from the following detailed description of the exemplary embodiments thereof, which description should be considered in conjunction with the accompanying drawings in which.

DETAILED DESCRIPTION OF THE EMBODIMENTS

Figure 1:
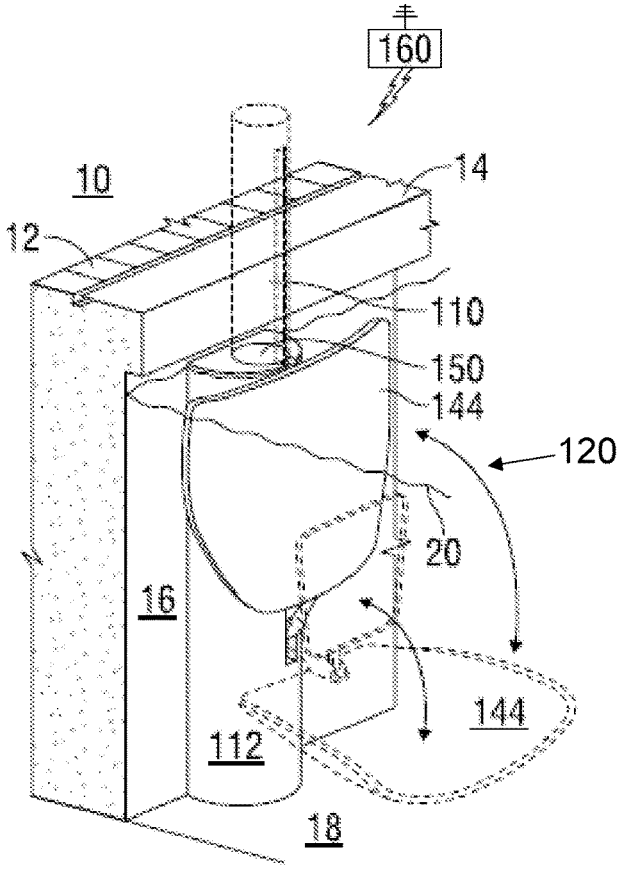
FIG. 1 is a fragmentary, perspective view of an exemplary embodiment of a water lift system with a lifting beam in a raised state and with a chair arm in a deployed state.

As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one skilled in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the features of the systems, apparatuses, and methods that are regarded as novel, it is believed that the systems, apparatuses, and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems, apparatuses, and methods will not be described in detail or will be omitted so as not to obscure the relevant details of the systems, apparatuses, and methods.

Before the systems, apparatuses, and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

The term "water-containing structure" (or "structure for short) includes, but is not limited to, pools (commercial and private), spas, hydrotherapy vessels, and tubs in which a person is to be immersed.

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, top/bottom, and proximal/distal. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

It will be appreciated that embodiments of the systems, apparatuses, and methods described herein may be comprised of one or more conventional processors and unique stored program instructions that control the one or more processors to implement, in conjunction with certain non-processor circuits and other elements, some, most, or all of the functions of the systems, apparatuses, and methods described herein. The non-processor circuits may include, but are not limited to, signal drivers, clock circuits, power source circuits, and user input and output elements. Alternatively, some or all functions could be implemented by a state machine that has no stored program instructions, or in one or more application specific integrated circuits (ASICs) or field-programmable gate arrays (FPGA), in which each function or some combinations of certain of the functions are implemented as custom logic. Of course, a combination of these approaches could also be used. Thus, methods and means for these functions have been described herein.

The terms "program," "software," "software application," and the like as used herein, are defined as a sequence of instructions designed for execution on a computer system or programmable device. A "program," "software," "application," "computer program," or "software application" may include a subroutine, a function, a procedure, an object method, an object implementation, an executable application, an applet, a servlet, a source code, an object code, any computer language logic, a shared library/dynamic load library and/or other sequence of instructions designed for execution on a computer system.

Herein various embodiments of the systems, apparatuses, and methods are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 2:
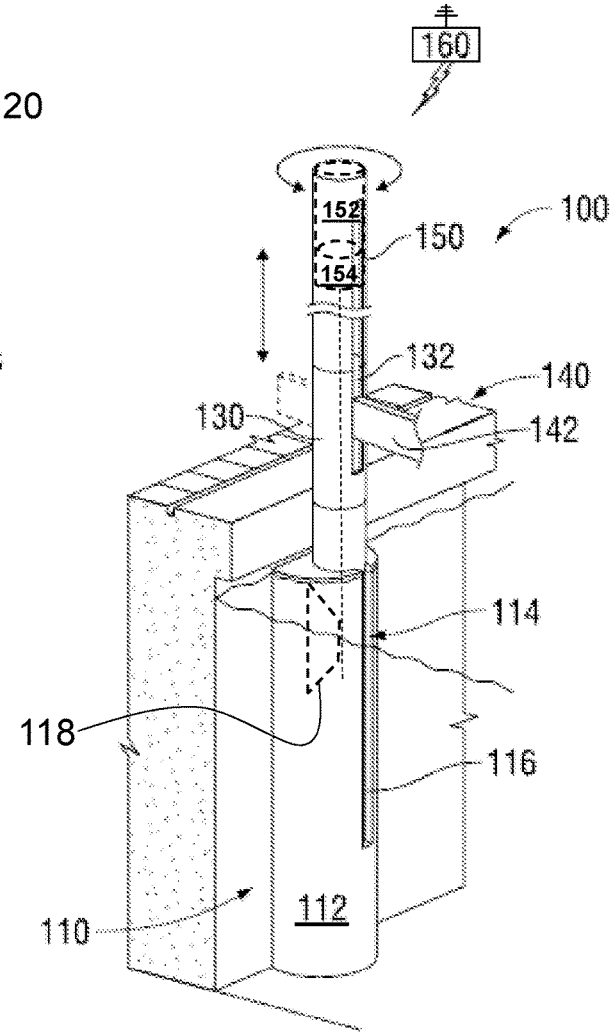
FIG. 2 is a fragmentary, perspective view of the water lift system of FIG. 1 with the lifting beam in a stored state and with a chair assembly in a stored state.

Described now are exemplary embodiments. Referring now to the figures of the drawings in detail and first, particularly to FIGS. 1 and 2, there is shown a first exemplary embodiment of a lift 100 for water entry/exit and methods of manufacture and use thereof. The lift 100 comprises a submerged base assembly 110 and a seat assembly 120. The base assembly 110 is configured to remain submerged in a water-containing structure 10, such as a pool or a Jacuzzi (whether using fresh water or salt water, for example). The exemplary embodiment of the water-containing structure 10 in FIGS. 1 and 2 is a pool having a deck 12, coping 14, an interior wall 16, and a floor 18, and is filled with water 20. As the lift 100 remains submerged in water for most of its useful life, the parts comprising the lift 100 are waterproof or are watertight, these terms being used interchangeably. As used herein, waterproof or watertight means that the parts are solid or are sufficiently sealed to prevent any ingress of moisture that would be detrimental to the functioning of the lift 100. If the part is simply a metal bar, then that can be considered waterproof as it inherently repels water and is not damaged from immersion, periodic or constant. If the part comprises various structures, such as sensors or motors, then either the parts are inherently waterproof or they are sealed sufficiently so that they can remain in water over a given life span substantially without deterioration.

The base assembly 110 in FIGS. 1 and 2 is fixed to the interior wall 16 and, therefore depending on the level of the water 18 maintained within the pool, the base assembly 110 is either entirely or mostly submerged at all times. The base assembly 110 has a base housing 112 fixed to the interior wall 16 and, in the exemplary embodiment, extends to the floor 18 of the pool. Fixation of the base housing 112 to the wall 16 can be direct or through a mounting bracket 118 shown diagrammatically in dashed lines in FIG. 2. To minimize injury should a swimmer/bather contact the base housing 112, the exterior surfaces of the base housing 112 are curved. In the exemplary embodiment, the exterior surface of the base housing 112 is cylindrical. To eliminate pointy surfaces, the base housing 112 can extend all the way down to the floor 18. The upper surface of the base housing 112 is illustrated as a flat, semi-circular plane but that surface can be curved upwards as well in the shape of half of a hemisphere, referred to as a quadrasphere. The base housing 112 can, alternatively, extend only partly downwards towards the floor 18 and end at a distance from the floor 18. In this alternative embodiment, the bottom surface of the base housing 112 can be a quadrasphere. Other shapes for the base are equally possible, such as polygonal shapes, elliptical shapes, and bell curves, to name a few. The base housing 112 defines a lifting arm chamber 114, in which is disposed a portion of the seat assembly 120. As will be described in further detail below, the lifting arm chamber 114 defines an arm slot 116 that communicates and extends from the interior of the lifting arm chamber 114 to the exterior surface of the base housing 112.

Disposed within the lifting arm chamber 114 is at least a portion of the seat assembly 120. The seat assembly 120 comprises a lifting beam 130, a chair assembly 140, and a drive assembly 150. In the exemplary embodiment, the lifting beam 130 comprises a movable cylinder that lowers into and raises from the cylindrical lifting arm chamber 114. Such cooperative shapes allow the lifting beam 130 not only to raise from the lifting arm chamber 114 but also to spin within the lifting arm chamber 114. This cooperative shaping allows for beneficial bidirectional movement that will be described in further detail below. The lifting beam 130 defines a seat arm chamber 132.

The chair assembly 140 comprises a chair arm 142 and a chair 144. The chair arm 142 is pivotally connected to the lifting beam 130 within the seat arm chamber 132. In this manner, as shown with dashed lines in FIG. 2, pivoting of the chair arm 142 within the seat arm chamber 132 allows the seat to move between a stowed position or state and a deployed position or state. In the exemplary embodiment, the chair 144 is rigidly connected to the chair arm 142. Thus, in the stowed position of the chair arm 142, the chair 144 also is in a stowed position or state where the chair 144 is parallel to the wall 16 in a vertical orientation (solid lines in FIG. 2). And, when the chair arm 142 pivots out of the seat arm chamber 132, the chair 144 pivots from the vertical orientation to a horizontal orientation into a deployed position or state (dashed lines in FIG. 2). Pivoting of the chair arm 142 with respect to the lifting beam 130 can be actively powered (by the drive assembly) or can occur passively by gravity (e.g., by weighting the chair and/or shaping the chair and chair arm accordingly) or can be both active and passive in various configurations.

As the chair assembly 140 is lowered in the deployed position to the full range of the arm slot 116, and the lifting beam 130 continues to lower, the base of the arm slot 116 acts as a cam to push on the underside of the chair arm 142 and pivots the chair arm 142 into the stowed position.

The drive assembly 150 is operatively connected to the lifting beam 130 and, in an exemplary embodiment comprises a power source 152 and a drive 154 powered by the power source, both shown diagrammatically in dashed lines in FIG. 2. Powered by the power source 152, the drive 154 moves the lifting beam 130 from a stowed position or state (shown in FIG. 2) to a deployed position or state (shown in FIG. 1). In an advantageous exemplary configuration, the power source 152 is a battery (that is solar powered or charged through a removable exterior cable connected to an electrical mains) and the drive 154 is an electric, battery-powered motor. The drive 154 can be a single drive (either directly or through a transmission) or it can be several separate drives operating in concert, e.g., through a microcontroller or by a gearing mechanism or by both. In an exemplary embodiment, the drive 154 to lift the lifting beam 130 is a worm screw, vertically mounted at a center of the lifting beam 130 and directly connected to the drive assembly 150 (shown diagrammatically with a dashed line as part of the drive 154). During the lift motion, in an exemplary embodiment, the drive assembly 150 is fixed in rotation relative to the base housing 112 and to the lifting beam 130 through, for example, the mounting bracket 118. Once the chair arm 142 has reached the fully extended position, the chair connector portion 132 of the lifting beam 130 permits rotation of the chair arm 142. In this regard, the chair assembly 140 can be rotated 180 degrees, either manually or mechanically.

In a particularly advantageous embodiment, the drive assembly 150 comprises a hermetically sealed, motor/battery replaceable/exchangeable part. Control of the lift 100 and, in particular, the drive assembly 150, is carried out by a controller 160, which is illustrated diagrammatically in FIG. 1. The exemplary embodiment of the controller 160 shown is a remote control with various non-illustrated user interfaces, which can be analog (e.g., buttons) and/or digital (e.g., microcomputer with software).

To operate the lift 100, reference is made to the progression of FIGS. 3 to 26. A stowed-to-deployed operation is shown in the progression from FIGS. 3 to 26 and a deployed-to-stowed operation is shown in the reverse progression FIGS. 26 to 3. In general, the user-supporting seat assembly is configured to be stored in a compact form within the water, therefore, preserving the aesthetic of the water-containing structure in which a person is to enter and exit. With an actuation of the controller 160, the lifting beam 130 with the chair 144 emerges vertically from the water. Once emerged, the chair connector portion 132 of the lifting beam 130 permits rotation of the seat assembly 120 on a vertical axis until the seat assembly 120 is over an adjacent portion of a deck 10, 12, thereby becoming easily accessible to the user. Before, during, or after the rotation of the lifting beam, the chair arm 142 is lowered to unfold the chair 144 along with the chair's seat back 146 and/or footrest(s) 148 to receive an occupant or rider. The chair connector portion 132 of the lifting beam 130 then permits rotation of the seat assembly 120 about the vertical axis until the chair 144 is over the water. The lifting beam 130 then lowers to submerge the chair 144 and rider and allow discharge of the rider into the water. This process can occur with a minimal number of user interface actions or with one actuation for each step. For example, in a two-actuation process, the controller 160 is actuated in a first step to move the chair onto the deck in an occupant-ready state and is actuated in a second step, after the occupant(s) is(are) safely seated, to rotate and lower the occupant(s) into the water. It is noted that only one chair 144 is illustrated, however, the chair 144 can also be a bench or a set of chairs to accommodate more than a single occupant.

Figure 3:
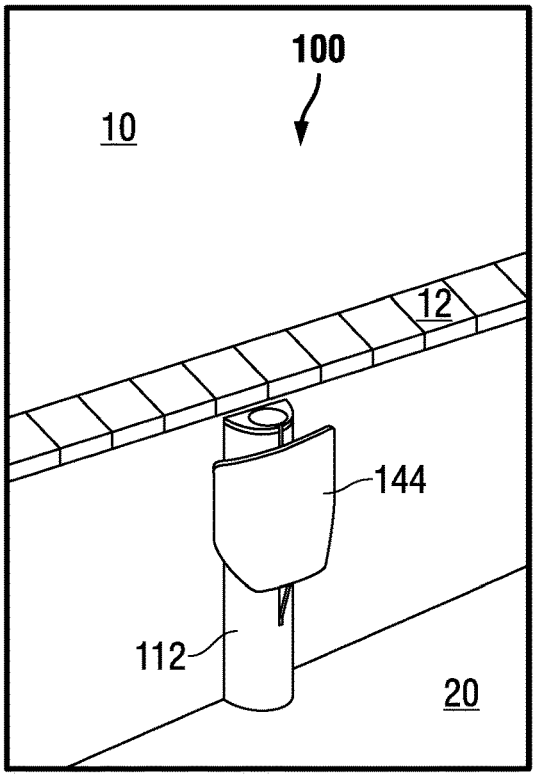
FIG. 3 is a fragmentary, perspective view of an exemplary embodiment of a water lift system with a lifting beam in a stored state and with a chair assembly in a stored state.
Figure 4:
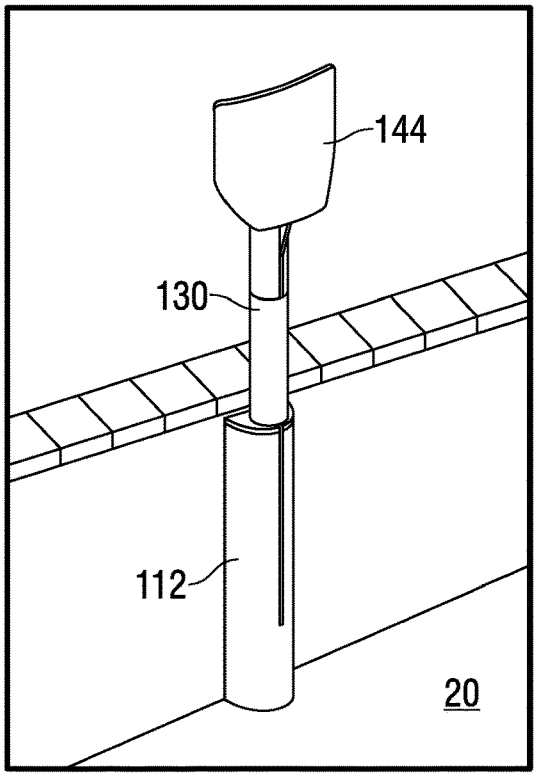
FIG. 4 is a fragmentary, perspective view of the water lift system of FIG. 3 with the lifting beam in a raised state and with the chair assembly in the stored state.
Figure 5:
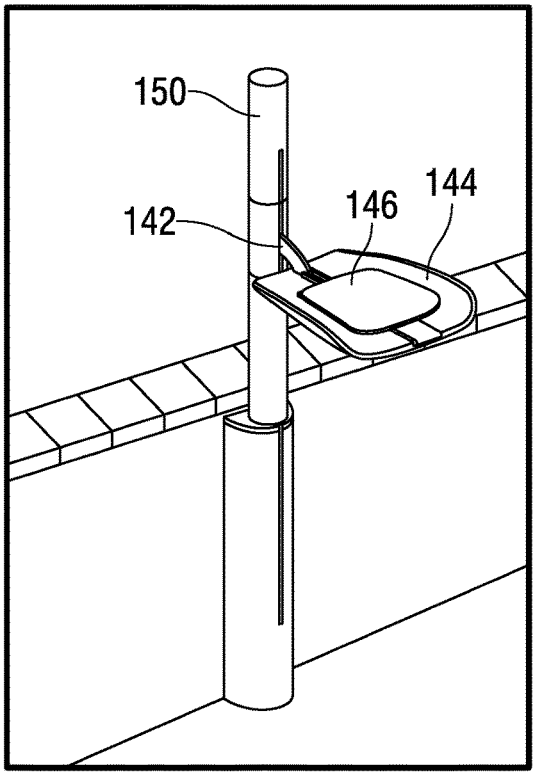
FIG. 5 is a fragmentary, perspective view of the water lift system of FIG. 3 with the lifting beam in the raised state and with the chair assembly in a partially deployed state with the chair deployed and the back rest and footrest stored.
Figure 6:
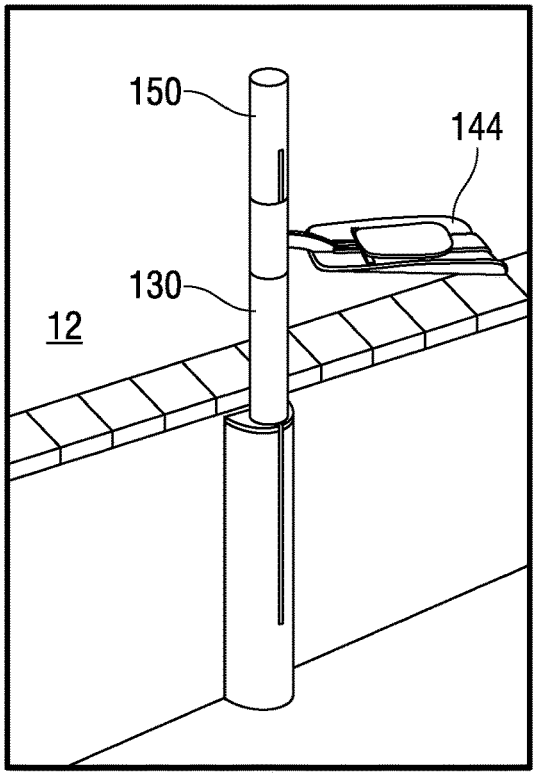
FIG. 6 is a fragmentary, perspective view of the water lift system of FIG. 5 with the lifting beam in a partially rotated state.
Figure 7:
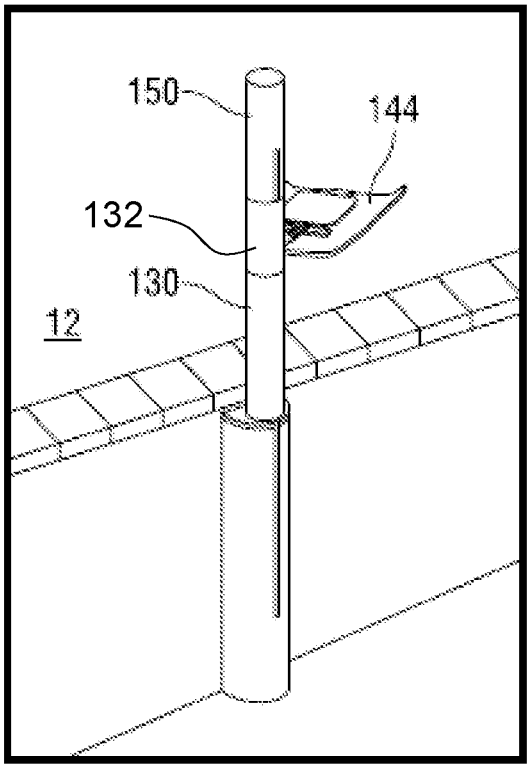
FIG. 7 is a fragmentary, perspective view of the water lift system of FIG. 5 with the lifting beam in a partially rotated state.
Figure 8:
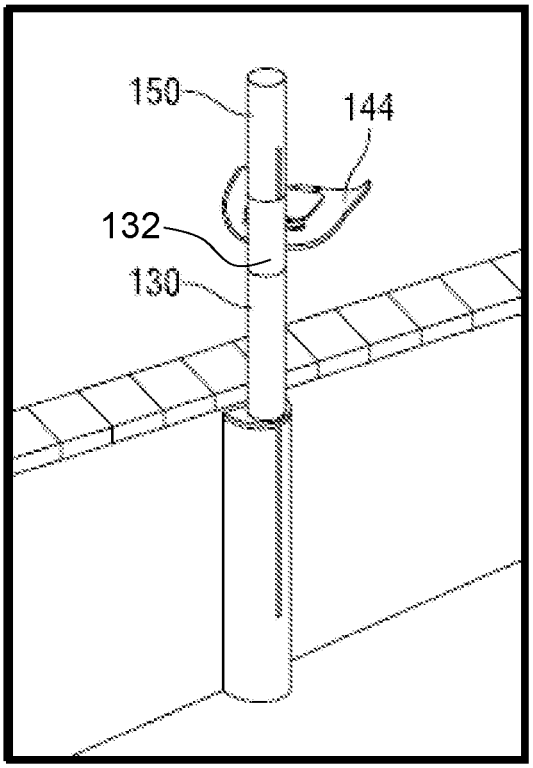
FIG. 8 is a fragmentary, perspective view of the water lift system of FIG. 5 with the lifting beam in a partially rotated state.
Figure 9:
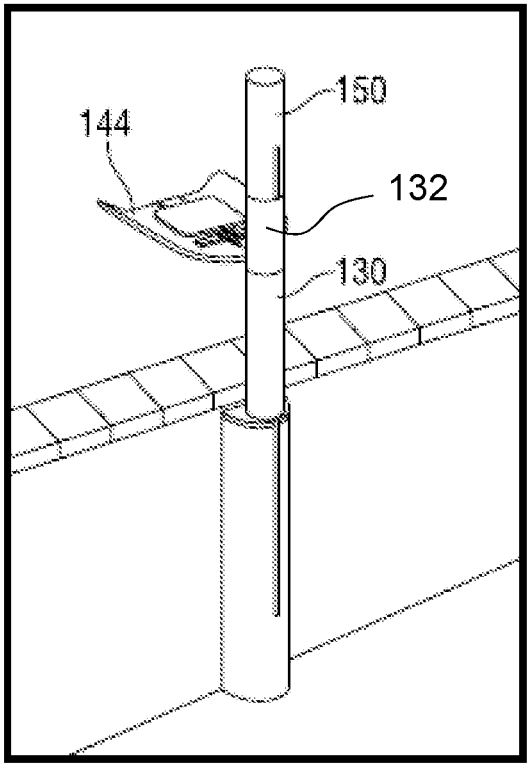
FIG. 9 is a fragmentary, perspective view of the water lift system of FIG. 5 with the lifting beam in a fully rotated state.
Figure 10:
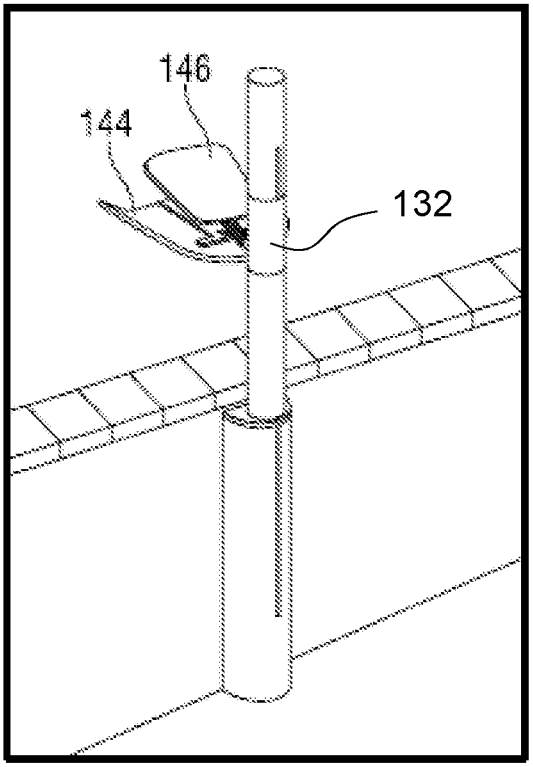
FIG. 10 is a fragmentary, perspective view of the water lift system of FIG. 3 with the lifting beam in the raised and fully rotated state and with the chair assembly in a partially deployed state with the chair deployed, with the back rest partially deployed, and with the footrest stored.
Figure 11:
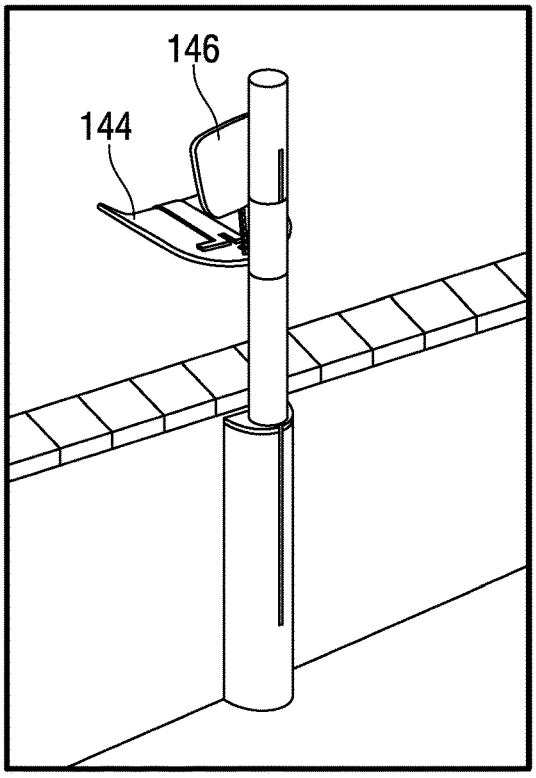
FIG. 11 is a fragmentary, perspective view of the water lift system of FIG. 3 with the lifting beam in the raised and fully rotated state and with the chair assembly in a partially deployed state with the chair and back rest deployed and with the footrest stored.
Figure 12:
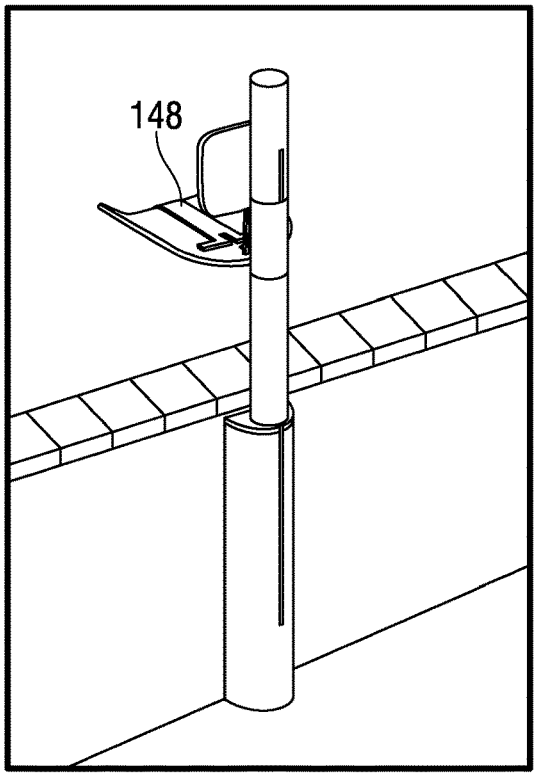
FIG. 12 is a fragmentary, perspective view of the water lift system of FIG. 3 with the lifting beam in the raised and fully rotated state and with the chair assembly in a partially deployed state with the chair and back rest deployed and with the footrest partially deployed.
Figure 13:
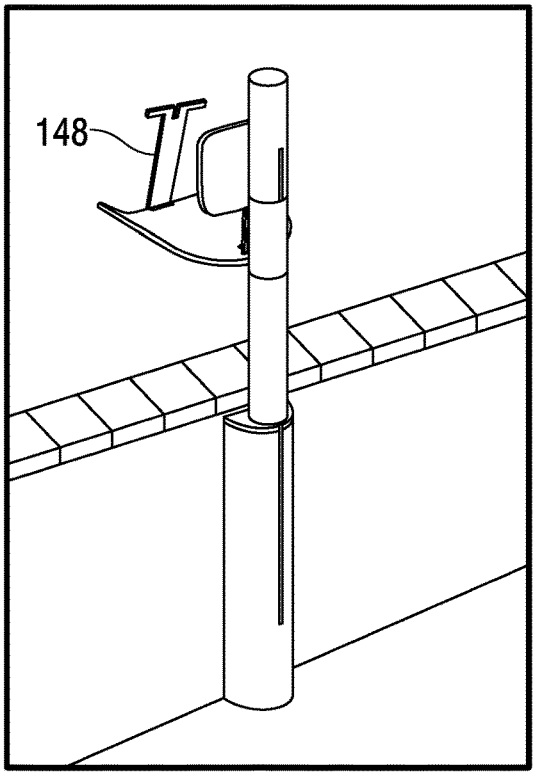
FIG. 13 is a fragmentary, perspective view of the water lift system of FIG. 3 with the lifting beam in the raised and fully rotated state and with the chair assembly in a partially deployed state with the chair and back rest deployed and with the footrest partially deployed.
Figure 14:
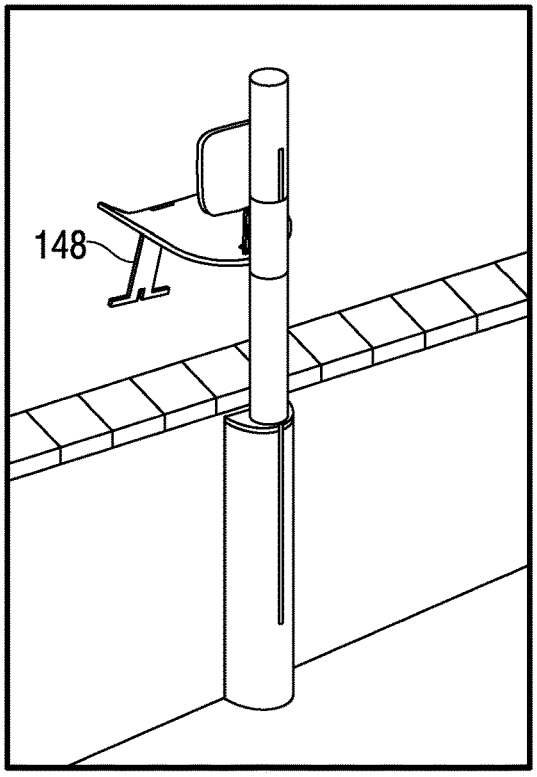
FIG. 14 is a fragmentary, perspective view of the water lift system of FIG. 3 with the lifting beam in the raised and fully rotated state and with the chair assembly in a partially deployed state with the chair and back rest and footrest in a fully deployed state.

Operation is now described. The lift 100 is activated by the user, or others, by remote control or by other directly connected measures. In FIG. 3, the lift 100 rests in the stored state ready for use by an occupant, with the entire device below the water 20 and the chair 144 in the stowed state. The user activates the lift 100 and, as shown in FIG. 4, the drive assembly 150 raises the lifting beam 130, which elevates the chair 144 out of the water 20. Either the drive assembly 150 or gravity (or a combination of both) pivots the chair arm 142 to lower the chair 144 into a deployed position or state, which is shown in FIG. 5. In this exemplary embodiment, the chair assembly 140 also includes a seat back 146, which is in a stowed state resting against and/or in line with the chair 144. As shown in FIG. 6, the drive assembly 150 rotates the chair connector portion 132 of the lifting beam 130 around its vertical longitudinal axis, which causes the chair 144 to rotate from over the water around towards a position above the deck 12 of the water-containing structure 10. FIGS. 7, 8, and 9 illustrate the chair connector portion 132 of the lifting beam 130 in various rotational positions around the vertical longitudinal axis until the chair 144 rests in a position above the deck 12. When the chair connector portion 132 of the lifting beam 130 is fully rotated to place the chair 144 above the deck 12, the seat back 16 is moved from the stored position into the deployed position, which is shown in the progression of FIGS. 10 and 11. In this exemplary embodiment of the chair assembly 140, with the seat back 16 deployed, a footrest 148 is automatically or manually lowered from a stowed position or state to a deployed position or state. The footrest 148 movement is illustrated in the progression from FIG. 12 to FIG. 14. The exemplary embodiment of the lift 100 is now ready for receiving an occupant.

Figure 15:
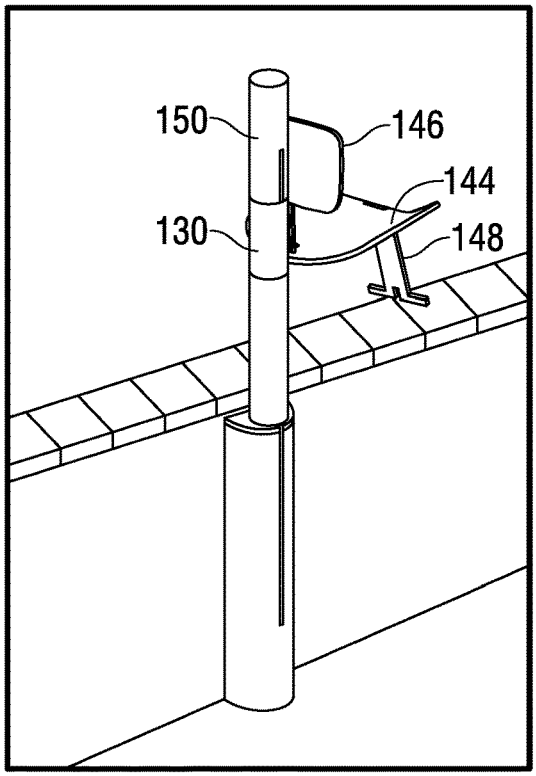
FIG. 15 is a fragmentary, perspective view of the water lift system of FIG. 14 with the lifting beam in the raised and partially rotated state and with the chair assembly in an occupied state with the chair and back rest and footrest fully deployed.
Figure 16:
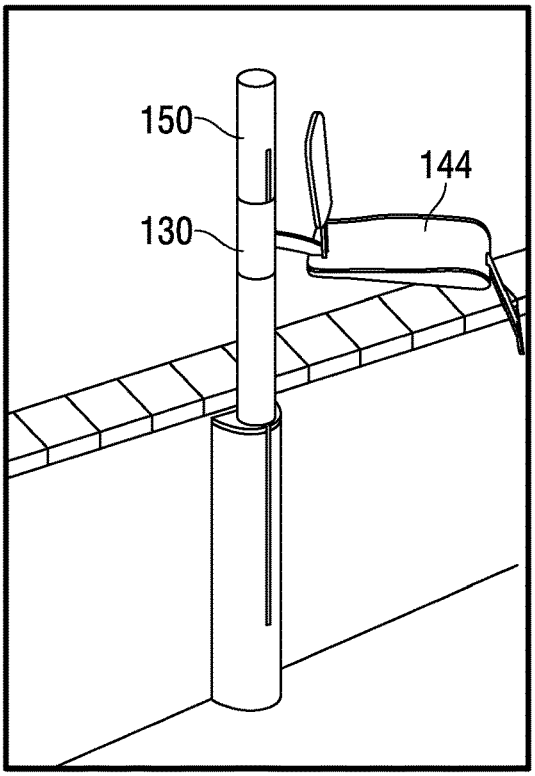
FIG. 16 is a fragmentary, perspective view of the water lift system of FIG. 14 with the lifting beam in the raised and partially rotated state and with the chair assembly in the occupied state with the chair and back rest and footrest fully deployed.
Figure 17:
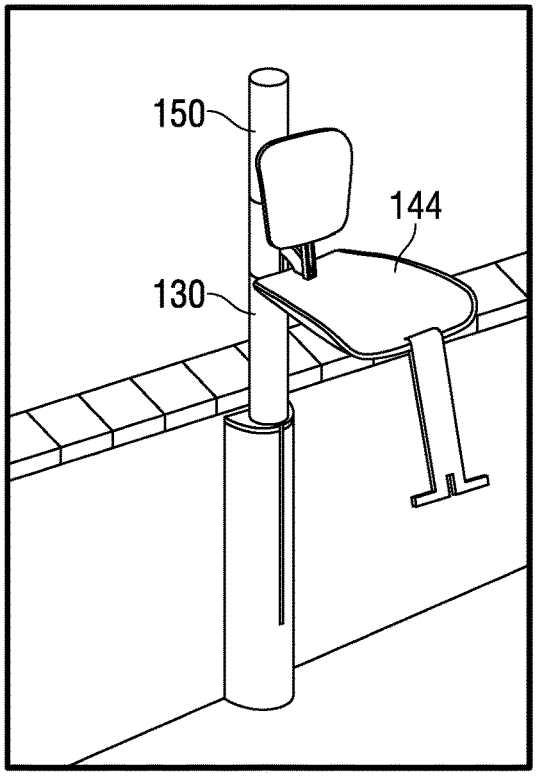
FIG. 17 is a fragmentary, perspective view of the water lift system of FIG. 14 with the lifting beam in the raised state and with the chair assembly in the occupied state with the chair and back rest and footrest fully deployed.
Figure 18:
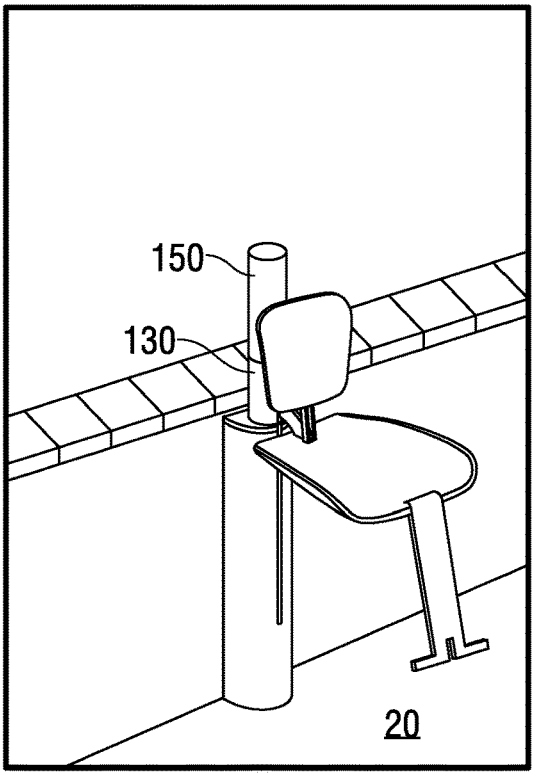
FIG. 18 is a fragmentary, perspective view of the water lift system of FIG. 3 with the lifting beam in a partially raised state and with the chair assembly in the occupied state with the chair and back rest and footrest fully deployed.
Figure 19:
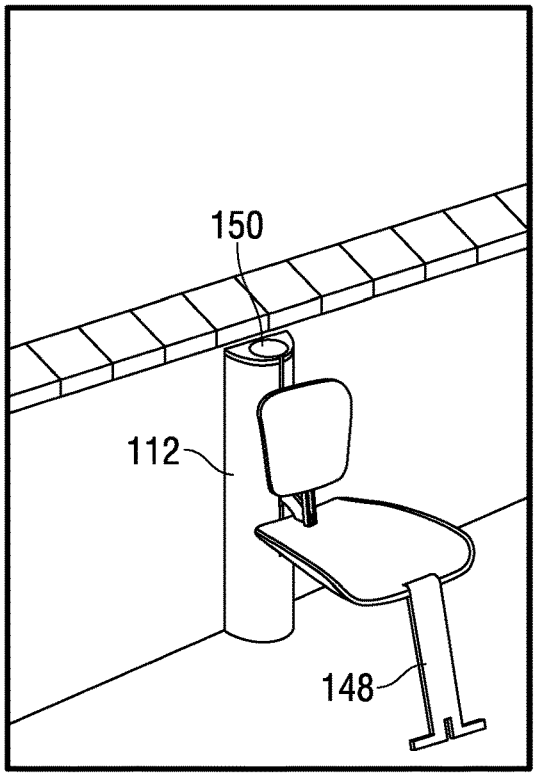
FIG. 19 is a fragmentary, perspective view of the water lift system of FIG. 3 with the lifting beam in the stored state and with the chair assembly in the occupied state with the chair and back rest and footrest fully deployed.
Figure 20:
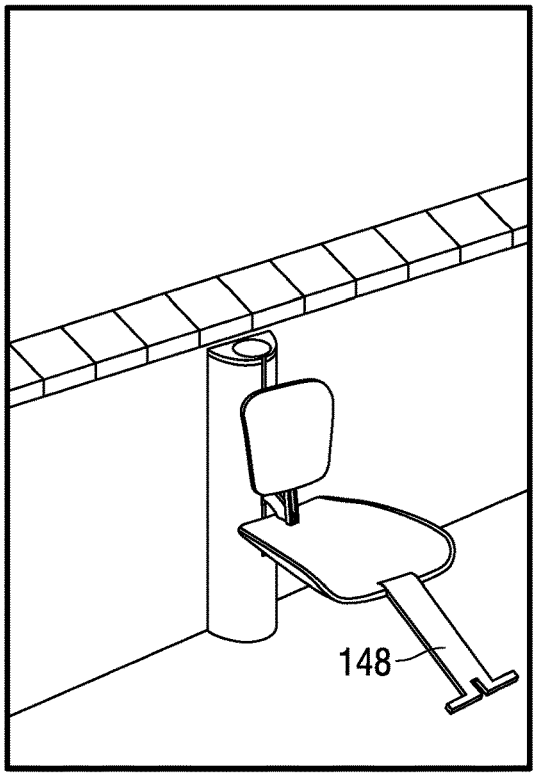
FIG. 20 is a fragmentary, perspective view of the water lift system of FIG. 3 with the lifting beam in the stored state and with the chair and back rest fully deployed and with the footrest partially retracted.
Figure 21:
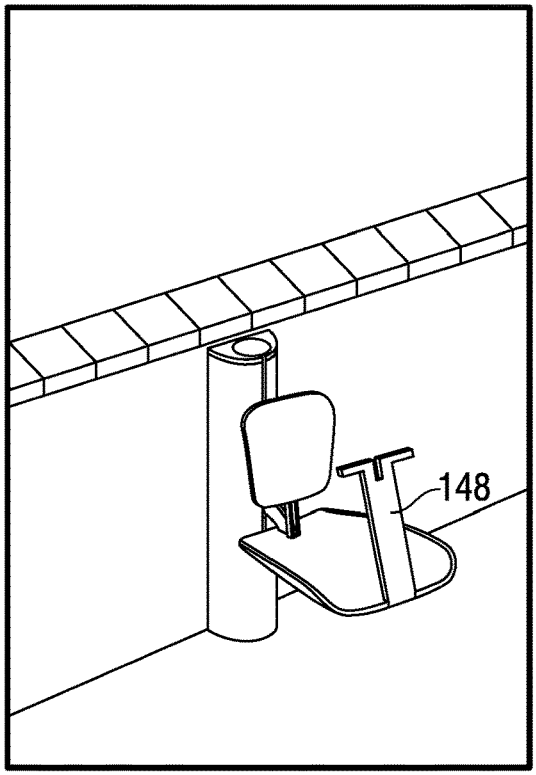
FIG. 21 is a fragmentary, perspective view of the water lift system of FIG. 3 with the lifting beam in the stored state and with the chair and back rest fully deployed and with the footrest partially retracted.
Figure 22:
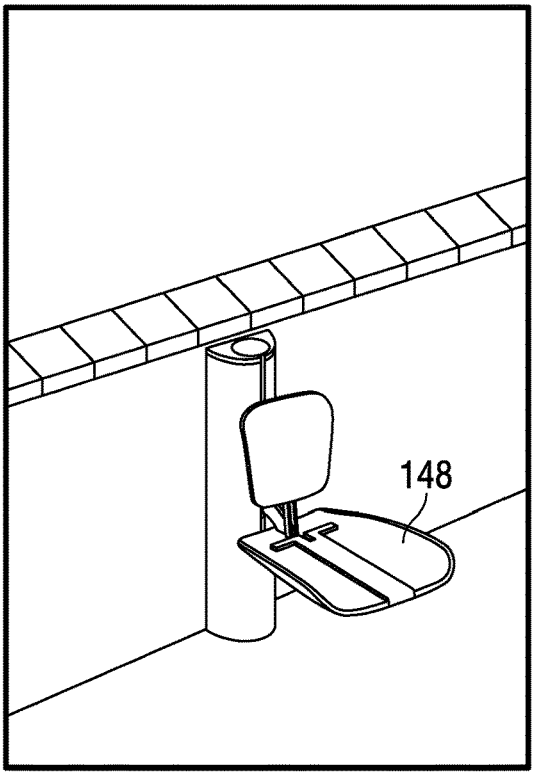
FIG. 22 is a fragmentary, perspective view of the water lift system of FIG. 3 with the lifting beam in the stored state and with the chair and back rest fully deployed and with the footrest stored.
Figure 23:
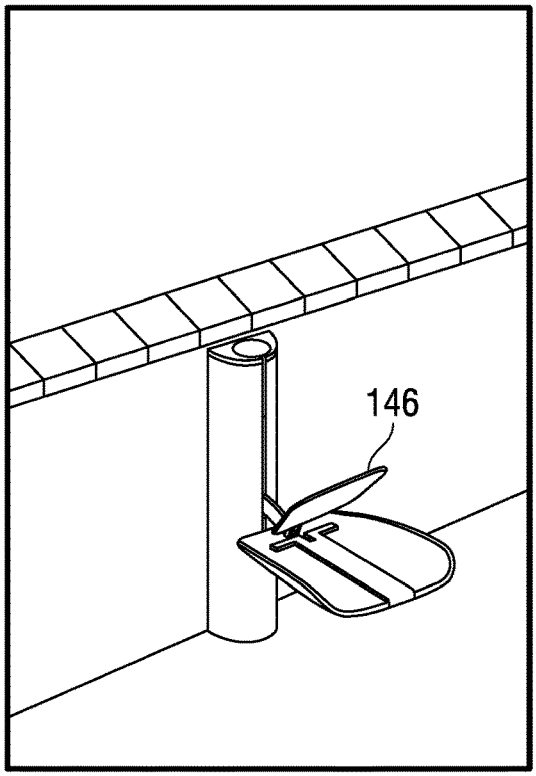
FIG. 23 is a fragmentary, perspective view of the water lift system of FIG. 3 with the lifting beam in the stored state and with the chair fully deployed and with the back rest partially deployed and with the footrest stored.
Figure 24:
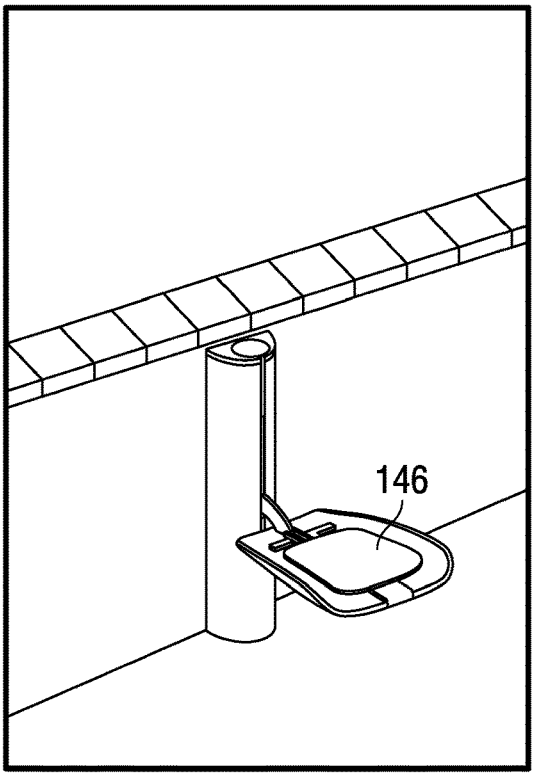
FIG. 24 is a fragmentary, perspective view of the water lift system of FIG. 3 with the lifting beam in the stored state and with the chair fully deployed and with the back rest and footrest stored.
Figure 25:
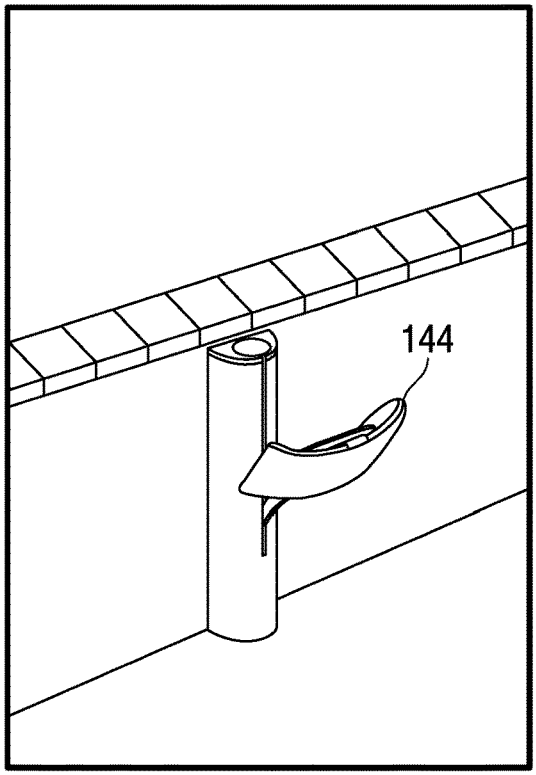
FIG. 25 is a fragmentary, perspective view of the water lift system of FIG. 3 with the lifting beam in the stored state and with the chair partially deployed and with the back rest and footrest stored.
Figure 26:
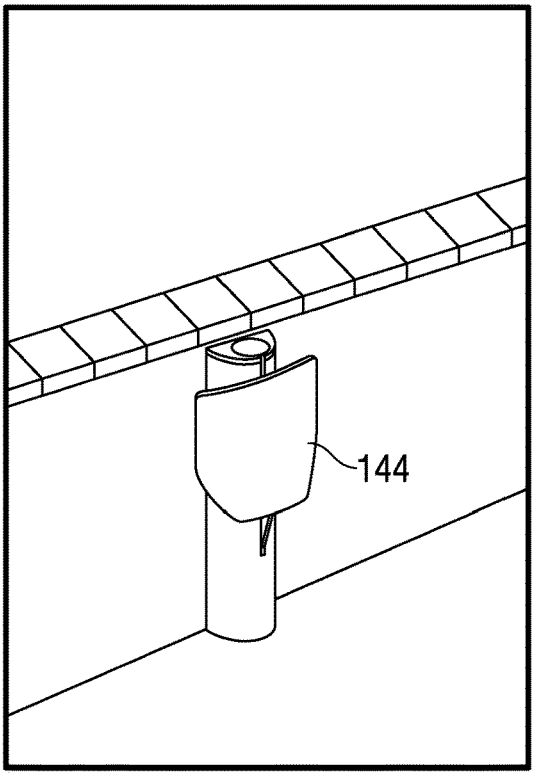
FIG. 26 is a fragmentary, perspective view of the water lift system of FIG. 3.

With the occupant seated on the chair 144, the controller 160 can be actuated for delivery of the occupant into the water or various sensors can detect and/or record the seated occupant and begin the lower procedure. Even though the occupant is not shown in FIGS. 15 to 26, explanation of these figures assumes that an occupant is seated safely in the chair 144. With a lower-ready signal transmitted to the drive assembly 150, rotation of the chair connector portion 132 of the lifting beam 130 occurs, which rotation is shown in the progression of FIGS. 15 to 17. With the chair 144 over the water 20, the drive assembly 150 lowers the lifting beam 130 with the chair assembly 140 into the water 20. Lowering of the chair 144 is depicted starting from FIG. 17 and ending at FIG. 19, in which the chair 144 is fully submerged in the water 20 and the lifting beam 130 is at its lowermost position or state. At this point, the occupant moves off of the chair 144 into the pool. The lift 100 can remain in this position with the chair 144 in a ready-to-occupy state or the chair 144 can be stowed. In the latter case, which is shown in the progression from FIG. 19 to FIG. 26, the exemplary embodiment first has the footrest 148 move from the deployed position (FIG. 19) to the stowed position (FIG. 22). Then, the seat back 146 is moved from the deployed position (FIG. 22) to the stowed position (FIG. 26). At this point, the lift 100 is ready for use again to remove the swimmer from the pool by carrying out the steps shown in reverse from FIG. 26 to FIG. 3, for example.

Advantageously, the lift 100 is a self-contained apparatus that folds to a nominal profile against the interior wall 16 of the structure 10. This provides a nominal and gradual protruding profile into the space in order to minimally affect use of the water-containing structure 10 by swimmers/users.

It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems, apparatuses, and methods. However, the systems, apparatuses, and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems, apparatuses, and methods as defined by the following claims.

What is claimed is:

1. A lift for transporting a person into and out from a pool filled with water, having an interior wall, and having a user-accessible deck at which the user may enter the water, the lift comprising:

a waterproof base assembly configured to attach to the interior wall and have at least a majority of the base assembly remain submerged within the water in the pool, the base assembly comprising:

a base housing:

configured to be fixed to the interior wall;

comprising an exterior surface;

defining a lifting arm chamber; and defining an arm slot that fluidically communicates with the water and the lifting arm chamber and extends from an interior of the lifting arm chamber through the base housing to the exterior surface into the water to expose at least a portion of the lifting arm chamber to the water, the arm slot having an open top and a lower portion remaining submerged within the water;

a waterproof seat assembly comprising:

a lifting beam:

movably disposed with respect to the base housing within the lifting arm chamber and configured to extend into and out from the lifting arm chamber at least in a vertical direction; and comprising a chair connector portion configured to freely rotate with respect to the lifting beam from a position above the water to a position above the user-accessible deck responsive to at least a portion of the chair connector portion being raised out from the water, the chair connector portion defining at least a portion of a seat arm chamber; and a chair assembly comprising:

a chair arm pivotally connected to the chair connector portion and movably connected through the arm slot to the lifting beam within the seat arm chamber to travel between a stowed position of the chair arm and a deployed position of the chair arm, the arm slot restricting rotation of the chair connector portion until the chair arm exits the open top of the arm slot; and a chair connected to the chair arm to travel between a stowed position of the chair and a deployed position of the chair; and a drive assembly operatively connected at least to the lifting beam and configured to raise and lower the lifting beam with respect to the lifting arm chamber, the base and seat assemblies configured to be stored in a compacted form within the water when not in use.

2. The lift according to claim 1, wherein the pool has a floor and the base housing extends to the floor.

3. The lift according to claim 1, wherein at least a portion of the exterior surface of the base housing is curved.

4. The lift according to claim 1, wherein the base housing is hemicylindrical in shape.

5. The lift according to claim 1, wherein the arm slot extends as a vertical slot radially from the interior of the lifting arm chamber to the exterior surface of the base housing.

6. The lift according to claim 5, wherein the chair arm is a beam that fits within and moves with respect to the vertical slot.

7. The lift according to claim 1, wherein:

the chair has a seating surface;

in the stowed position of the chair arm, the chair arm is in one of an angled orientation and a vertical orientation and at least a portion of the chair arm rests within the seat arm chamber; and in the deployed position of the chair arm, the chair arm is in an orientation to permit a person to sit on the seating surface of the chair and at least a portion of the chair arm extends out from the seat arm chamber.

8. The lift according to claim 7, wherein:

the lifting arm chamber defines a vertical axis; and the chair has a seating surface and:

in the stowed position of the chair arm, the seating surface is in an orientation at a given angle to the vertical axis such that a person cannot sit upon the chair; and in the deployed position of the chair arm, the seating surface is in an orientation in which a person can sit upon the chair.

9. The lift according to claim 1, wherein:

the lifting arm chamber is cylindrical in shape and has a vertical axis; and the lifting beam comprises:

a cylinder movable to lower into and raise from the lifting arm chambers; and the chair connector portion configured to rotate about the vertical axis.

10. The lift according to claim 9, wherein the lifting beam comprises:

a stored position responsive to being lowered into the lifting arm chamber; and a deployed position responsive to being at least partially raised from the lifting arm chamber.

11. The lift according to claim 1, wherein:

the lifting arm chamber has a vertical axis; and the chair has a seating surface and:

in the stowed position of the chair, the seating surface is at an angle to the vertical axis such that a person cannot sit upon the chair; and in the deployed position of the chair, the seating surface is in an orientation in which a person can sit upon the chair.

12. The lift according to claim 11, wherein:

in the stowed position of the chair, the chair arm is at a given angle to the vertical axis and has a portion within the base housing; and in the deployed position of the chair, the chair arm is in a deployed position out of the seat arm chamber at an angle greater than the given angle in a orientation in which a person can sit upon the chair.

13. The lift according to claim 1, wherein the drive assembly actively lifts and lowers the lifting beam between a stored vertical position and a deployed position.

14. The lift according to claim 1, wherein the chair arm freely pivots with respect to the chair connector portion based upon user action from a stored vertical position to a deployed position in which a person can sit upon the chair.

15. The lift according to claim 1, wherein the drive assembly comprises a power source and a drive powered by the power source.

16. The lift according to claim 15, wherein:

the power source is a battery and the drive is an electric, battery-powered motor; and at least a portion of the drive assembly is configured to be stored within the water when not in use.

17. The lift according to claim 15, wherein the drive assembly comprises a replaceable/exchangeable, hermetically sealed, motor/battery part.

18. The lift according to claim 15, wherein:

the chair comprises a seat back having a stowed position and a deployed position;

the chair comprises a footrest having a stowed position and a deployed position; and the seat back and the footrest are respectively movable between the stowed position and the deployed position.

19. The lift according to claim 1, wherein the drive assembly comprises a worm screw that, responsive to rotation, raises or lowers the lifting beam dependent upon a direction of rotation:

to raise the chair above the water responsive to rotation in a first direction; and to lower the chair into the water responsive to rotation in the direction opposite the first direction and which further comprises a mounting bracket, the base housing being fixed to the interior wall by at least the mounting bracket.

20. A lift for transporting a person into and out from a pool filled with water, having an interior wall, and having a user-accessible deck at which the user may enter the water, the lift comprising:

a waterproof base assembly configured to attach to the interior wall and have at least a majority of the base assembly remain submerged within the water in the pool, the base assembly defining a lifting arm chamber and defining an arm slot that fluidically communicates with the water and the lifting arm chamber to expose at least a portion of the lifting arm chamber to the water, the arm slot having an open top and a lower portion remaining submerged within the water;

a waterproof seat assembly comprising:

a lifting beam movably disposed in the lifting arm chamber at least in a vertical direction and comprising a chair connector portion configured to freely rotate with respect to the lifting beam from a position above the water to a position above the user-accessible deck responsive to at least a portion of the chair connector portion being raised out from the water, the chair connector portion defining at least a portion of a seat arm chamber; and a chair assembly comprising:

a chair arm pivotally connected to the chair connector portion and movably connected through the arm slot to the lifting beam within the seat arm chamber to travel between a stowed position of the chair arm and a deployed position of the chair arm, the arm slot restricting rotation of the chair connector portion until the chair arm exits the open top of the arm slot; and a chair connected to the chair arm to travel between a stowed position of the chair and a deployed position of the chair; and a drive assembly operatively connected at least to the lifting beam and configured to raise and lower the lifting beam with respect to the base assembly, the base and seat assemblies configured to be stored in a compacted form within the water when not in use.

21. A retrofitting lift for transporting a person into and out from a pool filled with water and having an existing interior wall, the lift comprising:

a waterproof base assembly configured to attach to the interior wall and, upon attachment, have at least a majority of the base assembly remain submerged within the water in the pool, the base assembly comprising a base housing shaped and configured to be fixed to the existing interior wall, the base housing having an exterior surface and defining a lifting arm chamber with an arm slot that fluidically communicates with the water and the lifting arm chamber and extends from an interior of the lifting arm chamber radially through the base housing to the exterior surface into the water to expose at least a portion of the lifting arm chamber to the water;

a waterproof seat assembly comprising:

a lifting beam movably disposed in the lifting arm chamber at least in a vertical direction and defining a seat arm chamber, the lifting beam comprising a chair connector portion configured to freely rotate with respect to the lifting beam from a position above the water to a position away from the water to point behind the interior wall responsive to at least a portion of the chair connector portion being raised out from the water; and a chair assembly comprising:

a chair arm pivotally connected to the chair connector portion and movably connected through the arm slot to the lifting beam within the seat arm chamber to travel between a stowed position of the chair arm and a deployed position of the chair arm; and a chair connected to the chair arm to tilt between the stowed and deployed positions of the chair arm, wherein, in the stowed position of the chair arm, the chair arm and the chair are submerged under water in the pool and the lifting beam is at least partly submerged under water in the pool; and a drive assembly operatively connected at least to the lifting beam and configured to raise and lower the lifting beam with respect to the lifting arm chamber, the base and seat assemblies configured to be stored in a compacted form within the water when not in use.

* * * * *